US008967574B2

(12) United States Patent
Forster

(10) Patent No.: US 8,967,574 B2
(45) Date of Patent: Mar. 3, 2015

(54) REINFORCEMENT OF HANG TAGS

(75) Inventor: Ian J. Forster, Essex (GB)

(73) Assignee: Avery Denninson Corporation, Glendale, CA (US)

( * ) Notice: Subject to any disclaimer, the term of this patent is extended or adjusted under 35 U.S.C. 154(b) by 0 days.

(21) Appl. No.: 13/102,492

(22) Filed: May 6, 2011

(65) Prior Publication Data

US 2012/0280103 A1 Nov. 8, 2012

(51) Int. Cl.
*B42F 13/00* (2006.01)
*B31D 1/02* (2006.01)

(52) U.S. Cl.
CPC ..... *B31D 1/024* (2013.01); *B31D 1/025* (2013.01); *B31D 1/026* (2013.01); *Y10S 248/903* (2013.01)
USPC ..... 248/342; 248/683; 248/317; 248/903; 40/299.01; 156/249

(58) Field of Classification Search
USPC ..... 248/342, 542, 543, 551, 682, 683, 317, 248/694, 915, 346.03, 903; 156/196, 199, 156/200, 201, 202, 204, 216, 226, 227, 230, 156/234, 238, 247, 248, 249, 252, 253, 256, 156/265, 277, 297, 299, 302; 428/78, 121, 428/131; 40/299.01, 27, 671, 674, 675; 24/595.1; 29/525.01
See application file for complete search history.

(56) References Cited

U.S. PATENT DOCUMENTS 338,685 A * 3/1886 Morrell ..... 40/27
1,717,443 A 6/1929 Flood
2,158,345 A * 5/1939 Weiss ..... 40/662
2,545,505 A * 3/1951 Wall ..... 40/27
4,407,524 A 10/1983 Trautlein
4,526,310 A * 7/1985 Lunde/ n et al. ..... 227/67
4,682,721 A 7/1987 Duchin
4,780,974 A * 11/1988 Mitchell ..... 40/674
5,583,489 A * 12/1996 Loemker et al. ..... 340/572.8
5,842,722 A * 12/1998 Carlson ..... 283/107
6,027,027 A * 2/2000 Smithgall ..... 235/488
6,073,758 A * 6/2000 Webster et al. ..... 206/6.1
6,199,309 B1 * 3/2001 Markarian ..... 40/299.01
6,254,953 B1 * 7/2001 Elston ..... 428/40.1
6,290,138 B1 * 9/2001 Ohno et al. ..... 235/492
6,395,373 B2 * 5/2002 Conti et al. ..... 428/138
6,506,467 B2 * 1/2003 Grosskopf et al. ..... 428/40.1
6,693,544 B1 * 2/2004 Hebbecker ..... 340/573.1
6,724,311 B1 * 4/2004 Kolton et al. ..... 340/572.8
6,845,581 B2 * 1/2005 Doerr et al. ..... 40/673
6,888,509 B2 * 5/2005 Atherton ..... 343/718
6,994,307 B2 * 2/2006 Curtsinger et al. ..... 248/317

(Continued)

*Primary Examiner* — Terrell McKinnon
*Assistant Examiner* — Monica Millner
(74) *Attorney, Agent, or Firm* — Avery Dennison Retail Information Services LLC

(57) ABSTRACT

Hang tags are provided for mounting on merchandise in a retail setting. The hang tags include a card with a plurality of edges, with a region of reinforcing material located at or adjacent to the top edge of the card, surrounding an aperture through which a fastener is received. The region defines the shape of a pair of intersecting elongated shapes such as ovals or ellipses, thereby positioning the reinforcing material in the locations where it is most needed to prevent theft-based removal of the tag from the merchandise, while omitting reinforcing material from the locations where it is not needed. Also provided is an attachment device, such as an applicator gun, for substantially simultaneously applying the reinforcing material to the tag and fastening the tag to a piece of merchandise.

16 Claims, 3 Drawing Sheets

(56) References Cited

U.S. PATENT DOCUMENTS

| | | | | |
|---|---|---|---|---|
| 7,005,027 | B2 * | 2/2006 | Valenti et al. | 156/202 |
| 7,124,524 | B2 * | 10/2006 | Valenti, Jr. | 40/27 |
| 7,204,652 | B2 * | 4/2007 | Warther | 400/76 |
| 7,584,896 | B2 * | 9/2009 | Warther | 235/492 |
| 7,728,733 | B2 * | 6/2010 | Baba et al. | 340/572.7 |
| 7,755,484 | B2 * | 7/2010 | Cullen et al. | 340/572.1 |
| 7,762,398 | B2 * | 7/2010 | Tokie et al. | 206/459.5 |
| 7,909,955 | B2 * | 3/2011 | Warther | 156/248 |
| 8,052,061 | B2 * | 11/2011 | Warther | 235/492 |
| 8,123,031 | B2 * | 2/2012 | Vax | 206/296 |
| 8,235,300 | B2 * | 8/2012 | Warther | 235/492 |
| 2002/0067602 | A1 * | 6/2002 | Muller | 361/782 |
| 2002/0100856 | A1 * | 8/2002 | Hatton | 248/683 |
| 2003/0200689 | A1 * | 10/2003 | Cohon | 40/673 |
| 2005/0108912 | A1 * | 5/2005 | Bekker | 40/633 |
| 2009/0277053 | A1 * | 11/2009 | Critelli | 40/27 |
| 2011/0147467 | A1 * | 6/2011 | Choi | 235/492 |
| 2011/0226833 | A1 * | 9/2011 | Gilbertson et al. | 227/8 |

* cited by examiner

REINFORCEMENT OF HANG TAGS

BACKGROUND

1. Field of the Disclosure

The present subject matter relates to merchandise hang tags. More particularly, the present subject matter relates to systems and methods for attaching and reinforcing merchandise hang tags.

2. Description of Related Art

It is known to employ radio frequency identification ("RFID") technology in an area (for example within a store or other retail environment) for various purposes. In one example, an RFID reader is associated with a point-of-sale location or check-out counter of a store and detects a tag associated with an item being purchased to register the price of the item. In another example, an RFID-readable tag or transponder is attached to each piece of merchandise in a store or storage area. The tags are scanned using an RFID reader to keep proper count of the product inventory. In yet another example, RFID technology is used as a security measure. In a typical RFID-based security system for a store, one or more RFID readers are installed adjacent to an exit, while guard tags are associated with (often by means of a hang tag or label) individual items sold in the store. When a customer purchases an item, the cashier will either remove or otherwise deactivate the guard tag associated therewith. If the guard tag has not been removed or deactivated (for example if a customer attempts to remove the item from the store without paying for it), the RFID reader or readers in the read field will sense the guard tag as the customer is exiting the store. Upon sensing the guard tag, the read field causes an alarm or other alert to trigger, thereby alerting store personnel to possible theft of the item.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as may be set forth in the claims appended hereto.

In one aspect, a merchandise hang tag comprises a card and a region of reinforcing material. The card has a plurality of edges, including a top edge. The region of reinforcing material is located at or adjacent to the top edge and defines the shape of a pair of intersecting elongated openings, such as ovals or elipses. Other geometric shapes by be used such as squares, rectangles, circles, triangles, slits, etc.

In another aspect, an attachment device is provided for attaching a hang tag to a piece of merchandise. The attachment device includes a housing having a handle configured to be gripped by a hand and a pin extending from the housing. Also provided are a supply of fasteners and a supply of reinforcing material, both associated with the pin. An actuator of the attachment device is configured to be operated to substantially simultaneously deploy a fastener and a portion of the reinforcing material to a hang tag.

In yet another aspect, a method is provided for attaching a hang tag to a piece of merchandise using an attachment device having a pin and an actuator. The hang tag is positioned adjacent to a piece of merchandise and then the pin of the attachment device is pressed through the hang tag and/or the piece of merchandise. The actuator of the attachment device is then operated to substantially simultaneously deploy a fastener and a reinforcing material to the hang tag.

DESCRIPTION OF THE ILLUSTRATED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
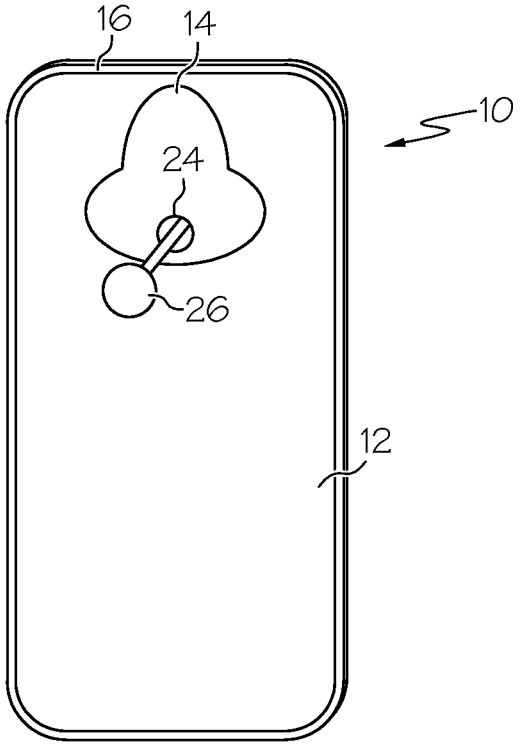
FIG. 1 is a perspective view of a merchandise hang tag according to aspects of the present disclosure.

As hang tags are used to prevent theft of merchandise, a thief has an incentive to remove the hang tag prior to passing through an area monitored by an RFID reader. The most common way to remove a hang tag is to grip it and abruptly pull downwardly. A hang tag generally includes a hole or aperture near its top edge for receipt of a fastener or tether, so pulling downwardly on the hang tag is common because it will require the minimum amount of force to rip the tag about the tether. FIG. 1 illustrates an improved hang tag 10 according to the present disclosure.

Figure 2:
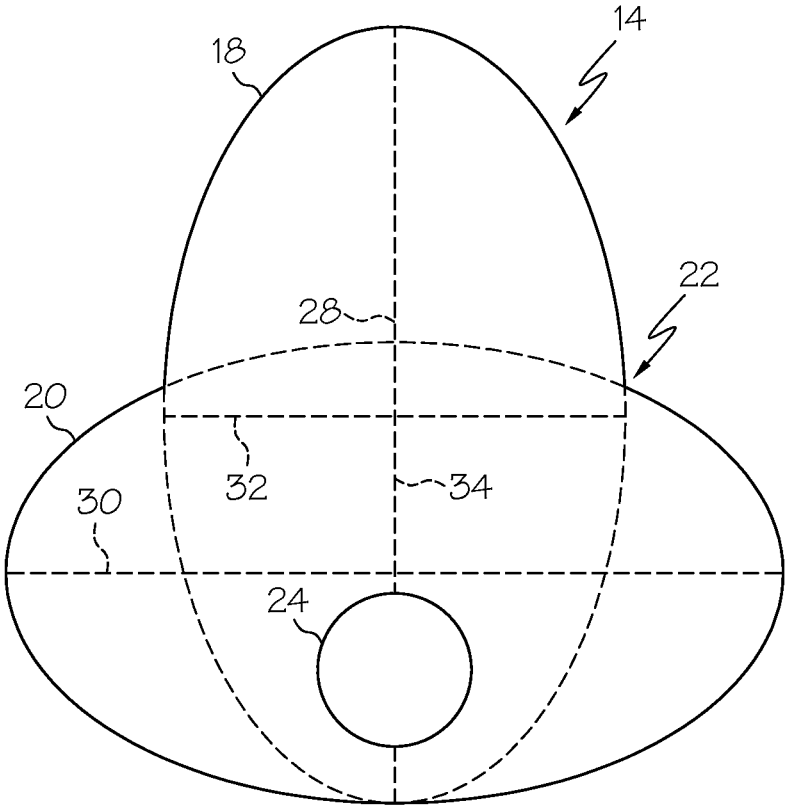
FIG. 2 is a detail view of the reinforcing material of the hang tag of FIG. 1.

The hang tag 10 of FIG. 1 is comparable to known hang tags in that it includes a card 12 having a plurality of edges, with a region of reinforcing material 14 printed or otherwise applied to the card 12 at or adjacent to one of the edges 16 (referred to herein as the top edge). In contrast to hang tags of known design, the hang tag 10 of FIG. 1 has reinforcing material 14 arranged in an optimal shape for preventing theft-related rupture of the hang tag 10, while avoiding the use of unnecessary reinforcing material. As best shown in FIG. 2, the reinforcing material 14 is arranged in the shape of a pair of intersecting elongated shapes 18 and 20 which (as shown in FIG. 2) may be geometric ellipses ovals or the like. It should be understood that the pair of intersecting ovals are for illustration and that other geometric shapes by be used such as squares, rectangles, circles, triangles, slits, etc.

Each of the elongated shapes when measured from the centre point of the hole, provides a length of reinforcing material that in the direction of most likely pull is at least twice that of the length of the material in the least likely direction, that is transverse to the direction of pull, and when engaged onto a ticket/tag, the edge of the elongated shape does not extend to the edge of the ticket to make it harder to peel the shape off. Defining the angular positions, such that the top of the ticket is 0 degrees, the length in the direction center to 0 degrees is >2× the length in the direction to 180 degrees, and that the length in direction to center 90 degrees and 270 degrees is >1.5× the length in direction 180 degrees.

In one embodiment, the reinforcing material 14 is present on the card 12 in a single layer, while in another embodiment the reinforcing material 14 is formed from the actual overlay of the two elongated shapes 18 and 20, such as ovals or elliptical shapes resulting in an area 22 with two layers or thicknesses of reinforcing material where the elongated shapes 18 and 20 overlap. In an illustrated arrangement, a surface area of one oval 18 engages an opposite-facing surface area of the other oval 20. A hole or aperture 24 for receiving a fastener or tether 26 (FIG. 1) may be positioned in the area 22 where the elongated shapes 18 and 20 overlap (either conceptually or physically).

It may be advantageous for the aperture 24 to be positioned relatively low—as oriented in FIG. 1 and FIG. 2—in the overlapping area 22 (i.e., farther from the top edge 16 of the card 12 of FIG. 1) to place more reinforcing material between the aperture 24 and the top edge 16, thereby increasing the force required to rip the card 12 through its top edge 16.

Each oval 18, 20 has a major axis 28, 30, respectively, and, if provided as an ellipse, each oval has a minor axis 32, 34, respectively. In the illustrated embodiment, the elongated shapes 18 and 20 are substantially identical to each other, with respective major axes 28 and 30 and minor axes 32 and 34 that are of substantially the same length and orientation.

In the embodiment of FIGS. 1 and 2, one of the elongated shapes 18 is oriented substantially vertically, with its major axis 28 substantially perpendicular to the top edge 16 of the card 12 and its minor axis 32 substantially parallel to the top edge 16 of the card 12. The other oval 20 of FIGS. 1 and 2 is oriented substantially horizontally, with its major axis 30 substantially parallel to the top edge 16 of the card 12 and its minor axis 34 substantially perpendicular to the top edge 16 of the card 12. In this orientation, the respective major axes 28 and 30 of the respective elongated shapes 18 and 20 (e.g. ovals or other elliptical shapes) are substantially perpendicular to each other. If the horizontally-oriented oval 20 is centered with respect to the vertically-oriented oval 18, the minor axis 34 of the horizontally-oriented oval 20 is aligned with the major axis 28 of the vertically-oriented oval 18 (FIG. 2).

By such a configuration of the reinforcing material 14, it can be seen that more material is positioned directly between the aperture 24 and the top edge 16 of the card 12 than between the aperture 24 and any other edge of the card 12. As described above, this is the portion of the hang tag 10 that is most likely to be ripped by a would-be thief when attempting to remove the hang tag 10, so it is advantageous for more reinforcing material 14 to be positioned there than in any other location on the card 12. The hang tag 10 may be pulled in a different direction, such as laterally to attempt to rip through one of its side edges, but doing so would require a difficult grip or pulling the fastener 26 through the entire length of the card 12, so there is less need for reinforcing material 14 in other locations around the aperture 24.

Figure 4:
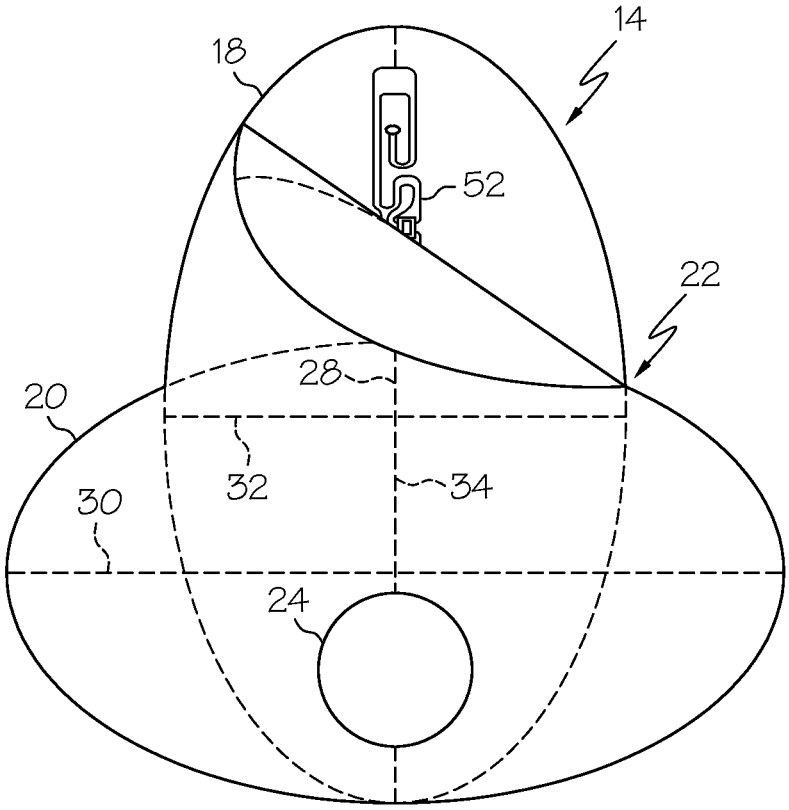
FIG. 4 is an embodiment of the current invention in which the reinforcing material of the hang tag contains a RFID-reactive strip.

The reinforcing material 14 may constitute any of a variety of materials (e.g., reinforced cellulosic material, such as fabric-reinforced paper, or a polymer such as polyvinyl chloride or polypropylene), or such materials in combination with metallic elements, such as steel or other foil, without departing from the scope of the present disclosure. In one embodiment, as shown in FIG. 4, the reinforcing material 14 has RFID properties, such as by carrying an RFID-reactive strap 52. If so configured, the reinforcing material 14, either by operating alone or in combination with the card 12 (e.g., if the card 12 includes an integrated antenna structure), serves to render the hang tag 10 visible by an RFID-reader. The reinforcing material 14 may also, or alternatively, have electrical properties, such as being a conductive "loop" or having a defined dielectric constant or magnetic permeability, such that the placement of the reinforcing material 14 alters the response of an RFID-readable device 52 integrated into the card 12.

In other embodiments, the reinforcing material 14 may have colored and/or optical (e.g., holographic) properties. A particular color may indicate the size of the associated merchandise (in the case of a piece of clothing, for example), while a hologram may act as an anti-counterfeit measure, while also enhancing the appearance of the hang tag 10. The reinforcing material 14 may further include additional or alternative coding, such as a rotational bar code or dot code. Combinations of these color, hologram, additional coding and/or alternative coding features can be provided in the products. In addition, the shape, in addition to providing the desired reinforcing, may be in the form of a logo or other recognizable indicator.

It may be advantageous for the reinforcing material 14 to be sufficiently strong that applying a downward force (in the orientation of FIG. 1) will cause damage to the piece of merchandise to which the hang tag 10 is attached prior to the hang tag 10 itself ripping. If the merchandise becomes damaged, it will reduce or eliminate its value to the thief, who may then abandon the attempt to pilfer the merchandise. This may be impractical or impossible for hang tags having reinforcing material arranged according to convention, but reinforcing material 14 as arranged according to the principles of the present disclosure make it possible.

For example, it has been found that the card of a hang tag having a conventionally shaped region of reinforcing material may be ripped through its top edge at a force of approximately 40 Newtons. In contrast, it has been found that significantly more force is required to rip through the top edge of a hang tag 10 having reinforcing material 14 arranged as in FIGS. 1 and 2. In one test, 140 Newtons of force was required to rip the card 12, in which case it was the body of the card 12 itself ripping, rather than the fastener 26 ripping through the reinforcing material 14 and the top edge 16 of the card 12. By applying a thicker or thinner layer of reinforcing material 14, applying the reinforcing material 14 in a larger or smaller region, and/or using an inherently stronger or weaker substance, the force required to rip through the reinforcing material 14 may be varied according to the needs of the user.

In another embodiment, rather than applying a thicker layer of reinforcing material 14, a similar effect may be achieved by applying a number of thinner layers to the hang tag 10. If the reinforcing material 14 is applied in multiple layers, the layers may be differently constituted (e.g., being comprised of slightly or substantially different materials or differing thicknesses) or be substantially identical to each other.

The reinforcing material 14 of FIGS. 1 and 2 may be applied by any of a number of methods, such as by a printing operation. In one version of such a process, the aperture 24 is cut or otherwise made in the card 12 prior to applying the reinforcing material 14. With the aperture 24 already defined, it may act as a guide by which to properly position the card 12 in a printer or comparable printing device and then the reinforcing material 14 may be applied to the card 12 in the proper region, surrounding the aperture 24. If there is to be any other printed material on the card 12 (e.g., a barcode or product information, etc.), it may be applied by the same printer or applied during a separate printing stage. With the hang tag 10 fully formed, it may subsequently be attached to a piece of merchandise according to known practice (i.e., with a standard applicator gun).

Figure 3:
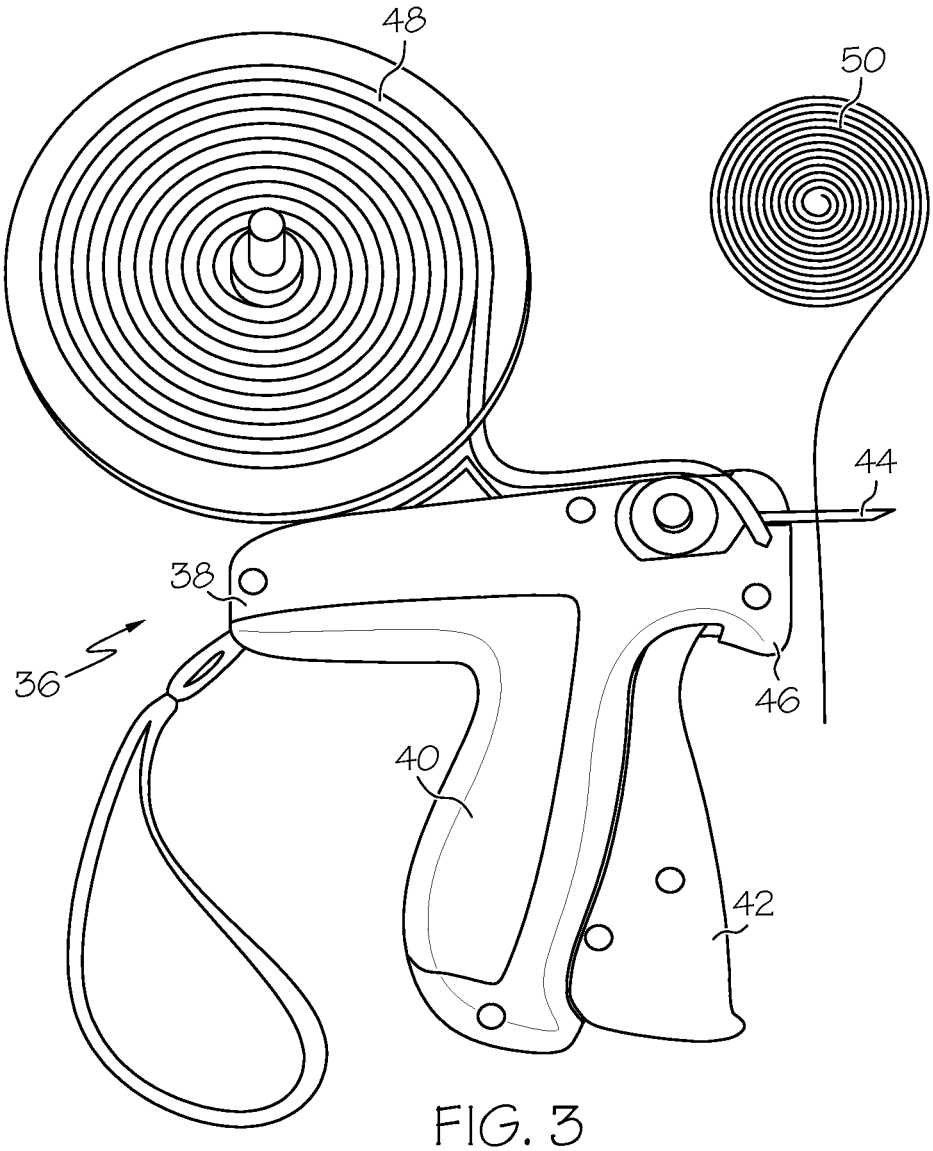
FIG. 3 is a front elevational view of an applicator gun suitable for substantially simultaneously attaching the hang tag of FIG. 1 to a piece of merchandise and applying the reinforcing material of FIG. 2 to the hang tag.

Alternatively, rather than applying the reinforcing material 14 prior to attaching the hang tag 10 to a piece of merchandise, the reinforcing material 14 may be applied at substantially the same time that the hang tag 10 is attached to the merchandise. To carry out such an application-attachment procedure, an attachment device or applicator gun 36 of the type illustrated in FIG. 3 may be employed.

The applicator gun 36 comprises a housing 38 with a generally downwardly extending handle 40 which is configured to be gripped by the hand of a user. The handle 40 includes an actuator or trigger 42 which is squeezed toward the handle 40 or otherwise operated by the user to substantially simultaneously deploy a fastener 26 (FIG. 1) and reinforcing material 14 (FIGS. 1 and 2) to the hang tag 10, as will be described in greater detail herein.

A pin or needle 44 extends from a front end 46 of the housing 38 to apply a fastener 26 from a fastener supply 48 according to conventional design, such as described in U.S. Pat. No. 4,682,721 to Duchin, which is incorporated herein by reference.

In addition to the fastener supply 48, the applicator gun 36 includes a reinforcing material supply 50 which is associated with the pin 44. To apply the reinforcing material 14, a hang tag 10 is positioned adjacent to a piece of merchandise. The pin 44 is pressed through the aperture 24 of the hang tag 10 and/or the piece of merchandise. Next, the actuator 42 is operated, which substantially simultaneously deploys a fastener 26 and the reinforcing material 14. As is conventional, the fastener 26 may be deployed by passing through a lumen or slot of the pin 44, with a forward T-bar end of the fastener 26 being positioned on a side of the merchandise opposite the side where the hang tag 10 is located. A trailing T-bar end of the fastener 26 prevents the hang tag 10 from detaching from the merchandise.

The manner in which the applicator gun 36 deploys the reinforcing material 14 to the hang tag 12 may vary, depending on the nature of the reinforcing material 14. In one embodiment, the reinforcing material supply 50 is provided as a plurality of individual decals or stickers which are shaped as in FIGS. 1 and 2 and positioned on a roll of low-adhesion release paper. As the actuator 42 is operated, the reinforcing material 14 is pressed against the hang tag 10 (either manually by moving the front end 46 of the housing 38 into engagement with the hang tag 10 or by function of a portion of the front end 46 moving to an extended position which presses the reinforcing material 14 against the hang tag 10), thereby applying the reinforcing material 14 to the hang tag 10. The roll of reinforcing material 14 may be manually or automatically advanced, such that a new decal will be properly positioned for when the actuator 42 is next operated by the user.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

What is claimed is:

1. A merchandise hang tag comprising:

a card having a plurality of edges, including a top edge;

a region of reinforcing material disposed on an exterior surface of the card and having RFID properties and located at or adjacent to the top edge, wherein the region defines the shape of a pair of substantially identical elongated shapes which intersect at an area, each of said elongated shapes has a major axis, with the respective major axes of the elongated shapes being substantially perpendicular to each other, and one major axis is generally vertically oriented with respect to the top edge of the card; and a fastener-receiving aperture positioned within the area where the elongated shapes intersect, the aperture being positioned at a location spaced away from the top edge by a distance greater than midway along the major axis that is generally vertically oriented wherein proportionally more reinforcing material is disposed on the card in a first direction leading from the aperture towards the top edge of the card than is disposed on the card in a second direction leading from the aperture towards any one of the remaining plurality of edges of the card.

2. The merchandise hang tag of claim 1, the wherein the region of reinforcing material occupies less than a total area of the card, and wherein the region of reinforcing material contains a RFID-reactive strip and the reinforcing material has RFID properties.

3. The merchandise hang tag of claim 1, wherein the region defines the shape of a pair of substantially identical, intersecting elongated shapes as ovals.

4. The merchandise hang tag of claim 1, wherein the region defines the shape of a pair of intersecting ellipses.

5. The merchandise hang tag of claim 1, wherein the region defines the shape of a pair of substantially identical, intersecting ellipses.

6. The merchandise hang tag of claim 1, wherein the aperture is positioned farther from the top edge of the card than the intersection of the respective major axes is positioned from the top edge of the card.

7. The merchandise hang tag of claim 1, wherein the area in which the elongated shapes intersect comprises a multi-layered area.

8. An attachment device for attaching a reinforced hang tag having RFID properties to a piece of merchandise, comprising:

a housing having a handle configured to be gripped by a hand;

a pin extending from the housing;

a supply of fasteners associated with the pin;

a supply of reinforcing material associated with the pin wherein the reinforcing material has RFID properties;

an actuator configured to be operated to substantially simultaneously deploy a fastener and a portion of the reinforcing material to an exterior surface of a card having at least one of barcode or product information to form the reinforced hang tag having RFID properties; and wherein the supply of reinforcing material is a plurality of individual decals or stickers positioned on a roll of low-adhesion release paper.

9. A method of attaching a reinforced hang tag having RFID properties to a piece of merchandise using an attachment device having a pin and an actuator, comprising:

positioning a card having at least one of barcode or product information adjacent to a piece of merchandise;

pressing the pin of the attachment device through the card and/or the piece of merchandise; and operating the actuator of the attachment device, thereby substantially simultaneously deploying a fastener and a reinforcing material having RFID properties to an exterior surface of the card to form the reinforced hang tag having RFID properties.

10. An attachment device for attaching a hang tag to a piece of merchandise, comprising:

a card having a plurality of edges, including a top edge;

a region of reinforcing material disposed on an exterior surface of the card and located at or adjacent to the top edge, wherein the region defines the shape of a pair of substantially identical elongated shapes which intersect at an area and the reinforcing material has RFID properties;

a fastener-receiving aperture positioned within the area where the elongated shapes intersect, wherein proportionally more reinforcing material is disposed on the card in a first direction leading from the aperture towards the top edge of the card than is disposed on the card in a second direction leading from the aperture towards any one of the remaining plurality of edges of the card;

each of the elongated shapes when measured from a center point the aperture to one of the plurality of edges in the first direction, provides reinforcing material least twice that of reinforcing material in a direction transverse to the first direction, and each of the elongated shapes when measured from a center point of the aperture to one of the plurality of edges perpendicular to the first direction, provides reinforcing material at least one and a half times that of reinforcing material in the direction transverse to the first direction, and an edge of the elongated shape does not extend to the edge of the card.

11. The attachment device for attaching a hang tag to a piece of merchandise of claim 10, wherein the region of reinforcing material defines the shape of a first elongated shape member overlying a second elongated shape member to provide a multi-layered region.

12. The attachment device hang tag of claim 10 wherein the force required to rip through the reinforcing material is significantly more than 40 Newtons.

13. The attachment device of claim 10, wherein a major axis of one of the elongated shapes is substantially perpendicular to the top edge, and a major axis of the other elongated shapes is substantially parallel to the top edge.

14. The merchandise hang tag of claim 10, wherein the region defines the shape of a pair of wherein each of said ellipses has a major axis, being the longest diameter of the ellipse, and the respective major axes of the ellipses are substantially perpendicular to each other.

15. The merchandise hang tag of claim 14, wherein each of said ellipses has a minor axis, being the shortest diameter of the ellipse, and the minor axis of one of the ellipses is aligned with the major axis of the other ellipse.

16. The merchandise hang tag of claim 14, wherein the major axis of one of the ellipses is substantially perpendicular to the top edge, and the major axis of the other ellipse is substantially parallel to the top edge.

* * * * *